US010209660B2

(12) United States Patent
Murakami

(10) Patent No.: US 10,209,660 B2
(45) Date of Patent: Feb. 19, 2019

(54) IMAGE FORMATION DEVICE WITH TONER INCREASE MODE

(71) Applicant: KONICA MINOLTA, INC., Chiyoda-ku, Tokyo (JP)

(72) Inventor: Masanori Murakami, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/707,200

(22) Filed: Sep. 18, 2017

(65) Prior Publication Data

US 2018/0081313 A1 Mar. 22, 2018

(30) Foreign Application Priority Data

Sep. 21, 2016 (JP) ..... 2016-183590

(51) Int. Cl.

| | |
|---|---|
| ***G03G 15/10*** | (2006.01) |
| ***G03G 15/00*** | (2006.01) |
| ***G03G 15/043*** | (2006.01) |
| ***G03G 15/06*** | (2006.01) |
| ***G03G 15/20*** | (2006.01) |

(52) U.S. Cl.

CPC ..... *G03G 15/556* (2013.01); *G03G 15/043* (2013.01); *G03G 15/065* (2013.01); *G03G 15/2039* (2013.01); *G03G 15/5016* (2013.01); *G03G 15/50* (2013.01); *G03G 2215/2045* (2013.01)

(58) Field of Classification Search

USPC .... 399/38, 42, 45–47, 55, 58, 60, 80–82, 85

See application file for complete search history.

(56) References Cited

U.S. PATENT DOCUMENTS

| | | | | |
|---|---|---|---|---|
| 5,734,947 | A | 3/1998 | Tanabe | |
| 8,797,615 | B2 * | 8/2014 | Itagaki | B41J 29/393 358/461 |
| 9,304,468 | B2 * | 4/2016 | Miyazaki | G03G 15/556 |
| 2003/0091370 | A1 | 5/2003 | Ono | |
| 2006/0245795 | A1 | 11/2006 | Kamiyama | |
| 2010/0086338 | A1 | 4/2010 | Hara et al. | |
| 2013/0084087 | A1 * | 4/2013 | Ikeda | G03G 15/2039 399/38 |

FOREIGN PATENT DOCUMENTS

| | | |
|---|---|---|
| JP | S60 218672 A | 11/1985 |
| JP | 2008-310109 A | 12/2008 |

OTHER PUBLICATIONS

The extended European Search Report dated Jan. 16, 2018, by the European Patent Office in corresponding European Application No. 17188273.1. (10 pages).

* cited by examiner

*Primary Examiner* — Hoan Tran

(74) *Attorney, Agent, or Firm* — Buchanan Ingersoll & Rooney PC

(57) ABSTRACT

Provided is an image formation device for forming a toner image as an image to be printed on a sheet to transfer and fix the unfixed toner image onto the sheet, wherein a density adjustment setting of optionally adjusting a density of a printed image by a user is provided as a printing condition, and a toner increase mode for applying, to the sheet, more toner than that in a case of selecting a maximum density selectable in the density adjustment setting is provided as a printing mode.

17 Claims, 9 Drawing Sheets

| DEVELOPMENT BIAS [V] | DEFAULT VALUE | +150 | +200 | +250 |
|---|---|---|---|---|
| TONER ADHESION AMOUNT [g/m$^2$] | 4.2 | 5.2 | 7.4 | 9.7 |
| ABRASION TEST EVALUATION | △ | △ TO ○ | ○ | ○ |

IMAGE FORMATION DEVICE WITH TONER INCREASE MODE

Japanese Patent Application No. 2016-183590 filed on Sep. 21, 2016, including description, claims, drawings, and abstract the entire disclosure is incorporated herein by reference in its entirety.

BACKGROUND

Technological Field

The present invention relates to an image formation device.

Description of the Related Art

Production of printed documents resistant to long-term storage has been demanded for image formation devices such as a copier, a printer, and a facsimile. Typically, there has been the method for evaluating whether or not a printed document exhibits document storage performance equivalent to that of a document written with ink. For example, in ISO11798, an evaluation method using a Taber abrasion testing machine has been proposed as "6.6 Resistance to wear." As another example, "Abrasion Testing Method by Plastic Abrasion Wheel" has been proposed in ISO9352.

For satisfying these types of evaluation, an image printed on a sheet needs to be resistant to abrasion. For image quality, an example of a typical image formation device has been disclosed in JP 2008-310109 A.

In the image formation device described in JP 2008-310109 A, when a character/line in a secondary color is formed, a toner height is higher at an edge portion of a character/line in a first color, and is lower at an edge portion of a character/line in a second color. This can reduce spattering of toner in an upper layer of the secondary color, leading to formation of a clear character/line in the secondary color.

However, in the image formation device described in JP 2008-310109 A, there is a problem that it is difficult to obtain high abrasion resistance required for the image printed on the sheet. For this reason, there are concerns that the printed document resistant to long-term storage cannot be obtained.

SUMMARY

The present invention has been made in view of the above-described points, and an object of the present invention is to provide an image formation device configured so that abrasion resistance of an image printed on a sheet can be improved and that a printed document resistant to long-term storage can be obtained.

To achieve the abovementioned object, according to an aspect of the present invention, there is provided an image formation device, reflecting one aspect of the present invention, for forming a toner image as an image to be printed on a sheet to transfer and fix the unfixed toner image onto the sheet, wherein a density adjustment setting of optionally adjusting a density of a printed image by a user is provided as a printing condition, and a toner increase mode for applying, to the sheet, more toner than that in a case of selecting a maximum density selectable in the density adjustment setting is provided as a printing mode.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
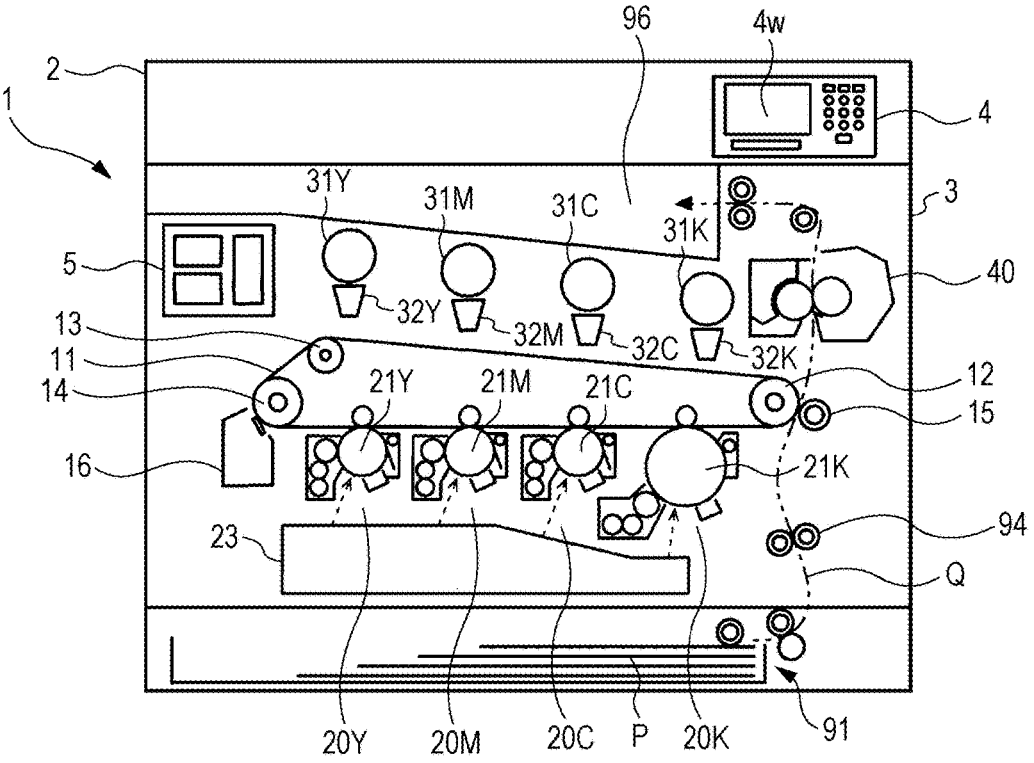
FIG. 1 is a partial longitudinal sectional view of an image formation device according to a first embodiment of the present invention from a front side.
Figure 2:
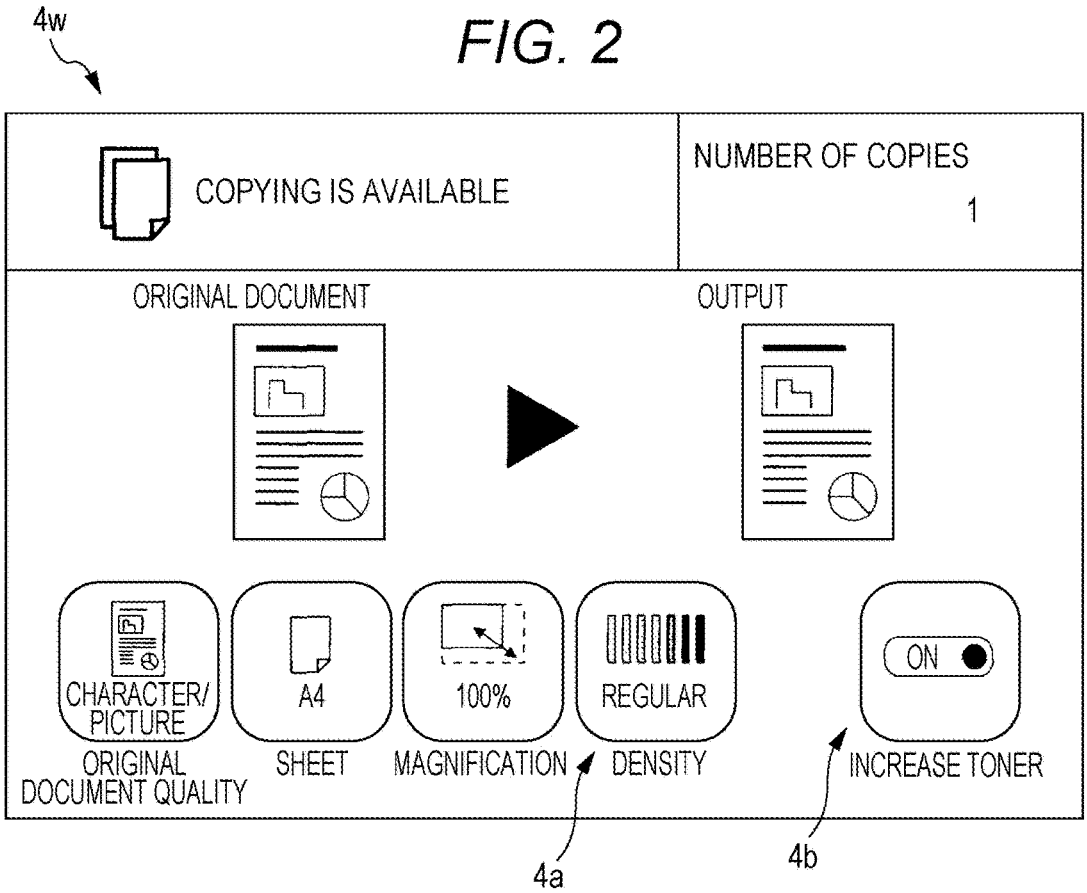
FIG. 2 is a front view of an example of a display of the image formation device according to the first embodiment of the present invention.

First, an outline structure of an image formation device according to a first embodiment of the present invention will be described with reference to FIGS. 1 and 2 while image output operation is described. FIG. 1 is an example of a partial longitudinal sectional view of the image formation device from a front side. FIG. 2 is a front view of an example of a display of the image formation device. A chain double-dashed arrow of FIG. 1 indicates a sheet conveyance path and a sheet conveying direction. An upper-to-lower direction, a right-to-left direction, and a depth direction in the plane of paper of FIG. 1 correspond respectively to an upper-to-lower direction, a right-to-left direction, and a depth direction of the image formation device.

The image formation device 1 is a so-called tandem color copier as illustrated in FIG. 1. The image formation device 1 includes an image reader 2 that reads an image of an original document, a printer 3 that prints the read image on a transfer material such as a sheet, an operator 4 that performs input of printing conditions and display of an operation status, and a main controller 5.

The image reader 2 is a well-known unit that moves a not-shown scanner to read the image of the original document placed on an upper surface of a not-shown platen glass. The image of the original document is color-separated into three colors of read (R), green (G), and blue (B), and then, is converted into an electric signal by a not-shown charge coupled device (CCD) image sensor. Thus, the image reader 2 obtains image data separated according to the colors of read (R), green (G), and blue (B).

For the image data obtained according to the colors by the image reader 2, various types of processing are performed at the main controller 5. Such data is converted into image data for each reproduced color of yellow (Y), magenta (M), cyan (C), and black (K), and then, the resultant is stored in a not-shown memory of the main controller 5. The image data obtained according to the reproduced colors and stored in the memory is subjected to the processing of correcting dislocation, and then, is read for each scanning line in synchronization with sheet conveyance for the purpose of performing optical scanning for a photosensitive drum 21 as an image carrier.

The printer 3 forms an image by an electrographic technique, thereby transferring and printing such an image onto a sheet. The printer 3 includes an intermediate transfer belt 11 configured such that an intermediate transfer body is formed as an endless belt. The intermediate transfer belt 11 is wound around a drive roller 12 and driven rollers 13, 14. The intermediate transfer belt 11 is rotatably moved counterclockwise by the drive roller 12 as viewed in FIG. 1.

The drive roller 12 press-contacts a secondary transfer roller 15 facing the drive roller 12 with the intermediate transfer belt 11 being interposed therebetween. At the point of the driven roller 14, an intermediate transfer cleaner 16 provided facing the driven roller 14 with the intermediate transfer belt 11 being interposed therebetween contacts an outer peripheral surface of the intermediate transfer belt 11. After a toner image formed on the outer peripheral surface of the intermediate transfer belt 11 has been transferred onto a sheet, the intermediate transfer cleaner 16 removes and cleans an adhering object such as toner remaining on the outer peripheral surface of the intermediate transfer belt 11.

Image formers 20Y, 20M, 20C, 20K corresponding respectively to the reproduced colors of yellow (Y), magenta (M), cyan (C), and black (K) are provided below the intermediate transfer belt 11. Note that in this description, these units will be, for example, sometimes collectively referred to as "image formers 20" without identification symbols of "Y," "M," "C," and "K," expect for a case where these units need to be distinguished from each other. The four image formers 20 are arranged in line from an upstream side to a downstream side of a rotation direction of the intermediate transfer belt 11 along the rotation direction. All of the four image formers 20 have the same configuration. Each image former 20 includes, around the photosensitive drum 21 that rotates clockwise as viewed in FIG. 1, a charger 22, an exposurer (an exposure device 23), a developer 24, a drum cleaner 25, and a primary transfer roller 26 (see FIG. 3).

A toner bottle 31 and a toner hopper 32 are, above the intermediate transfer belt 11, provided corresponding to an associated one of the four image formers 20 for the reproduced colors. A not-shown toner remaining amount detector that detects a toner amount inside is provided at each of the developer and the toner hopper 32. Moreover, a not-shown toner refill device is provided between the developer 24 and the toner hopper 32, and not-shown another toner refill device is provided between the toner hopper 32 and the toner bottle 31. When the remaining amount detector detects a decrease in the toner amount inside the developer 24, the refill device is driven such that the developer 24 is refilled with toner from the toner hopper 32. Further, when the remaining amount detector detects a decrease in the toner amount inside the toner hopper 32, the refill device is driven such that the toner hopper 32 is refilled with toner from the toner bottle 31. The toner bottle 31 is detachably provided at a device body, and as necessary, is replaceable with a new bottle.

The exposure device 23 as the exposurer is disposed below the image formers 20. The single exposure device 23 corresponds to the four image formers 20, and has not-shown four light sources, such as semiconductor lasers, corresponding separately to the four photosensitive drums 21. The exposure device 23 modulates the four semiconductor lasers according to image gradation data for each reproduced color, thereby separately emitting laser light corresponding to each reproduced color to the four photosensitive drums 21.

A sheet supply device 91 is provided below the exposure device 23. The sheet supply device 91 houses a stack of a plurality of sheets P inside and to feed out, one by one, the sheets P to a sheet conveyance path Q in the order from the uppermost layer of the sheet stack. The sheet P fed out from the sheet supply device 91 to the sheet conveyance path Q reaches the point of a registration roller pair 94. Then, the registration roller pair 94 corrects (skew correction) skew feeding of the sheet P while feeding the sheet P toward a contact portion (a secondary transfer nip portion) between the intermediate transfer belt 11 and the secondary transfer roller 15 in synchronization with rotation of the intermediate transfer belt 11.

At each image former 20, an electrostatic latent image is formed on a surface of the photosensitive drum 21 by the laser light irradiated from the exposure device 23, and then, is converted into a visible toner image by the developer 24. The toner image formed on the surface of the photosensitive drum 21 is primarily transferred onto the outer peripheral surface of the intermediate transfer belt 11 at such a point that the photosensitive drum 21 faces the primary transfer roller 26 with the intermediate transfer belt 11 being interposed therebetween. Then, in association with rotation of the intermediate transfer belt 11, the toner image of each image former 20 is sequentially transferred onto the intermediate transfer belt 11 at predetermined timing. In this manner, the overlapping toner images in the four colors of yellow, magenta, cyan, and black are formed as a color toner image (a printed image) on the outer peripheral surface of the intermediate transfer belt 11.

At the secondary transfer nip portion formed by contact between the intermediate transfer belt 11 and the secondary transfer roller 15, the color toner image primarily transferred onto the outer peripheral surface of the intermediate transfer belt 11 is transferred onto the sheet P synchronously sent by the registration roller pair 94.

A fixer 40 is provided above the secondary nip portion. The sheet P onto which the unfixed toner image has been transferred at the secondary nip portion is sent to the fixer 40, and then, the toner image is fixed onto the sheet P by heating and pressurization. The sheet P having passed through the fixer 40 is discharged to a sheet discharger 96 provided above the intermediate transfer belt 11.

The operator 4 is provided on the front side of the image reader 2, and includes a display 4*w*. A not-shown touch panel is provided on an upper surface of the display 4*w*, and detects a position touched by a user. FIG. 2 is an example of the display 4*w*, and illustrates a screen upon copying onto the sheet P. Icons, soft keys, buttons, etc. for setting printing conditions such as the type and size of the sheet P, scaling, and image density adjustment are arranged on the display 4*w*. For example, the image formation device 1 has, as the printing condition, the density adjustment setting of optionally adjusting the density of the image to be printed on the sheet P by the user, and displays a density adjustment icon 4*a* on the display 4*w*.

The operator 4 receives not only user's input of settings used for printing, such as the printing conditions including the type and size of the sheet P, scaling, and image density adjustment, but also input of settings such as a fax number and a transmitter's name in facsimile transmission, for example. Moreover, the operator 4 displays, on the display 4*w*, a device state, a precaution, an error message, etc., thereby functioning as a notifier that notifies the user of the device state, the precaution, the error message, etc.

For entire operation control, the image formation device 1 is provided with the main controller 5 including a not-shown CPU, an image processor, and not-shown other electronic components. The main controller 5 utilizes the CPU as a central processing unit and the image processor to control the components such as the printer 3 including the image formers 20, the fixer 40, etc. and the image reader 2 based on a program or data stored in the memory or an input program or data. In this manner, a series of image formation operation and printing operation is realized.

Moreover, the image formation device 1 includes a not-shown communicator that performs communication such as facsimile transmission/reception between the image formation device 1 and an external communication device or computer. The communicator includes a facsimile communicator and a network communicator. The facsimile communicator is connected to a phone line, and communicates the image data etc. with the external communication device via the phone line. The network communicator is connected to a network line, and communicates the image data, a control command, etc. with the external computer via the network line. The main controller 5 causes the communicator to transmit/receive data to/from the external communication device or computer, for example.

Figure 3:
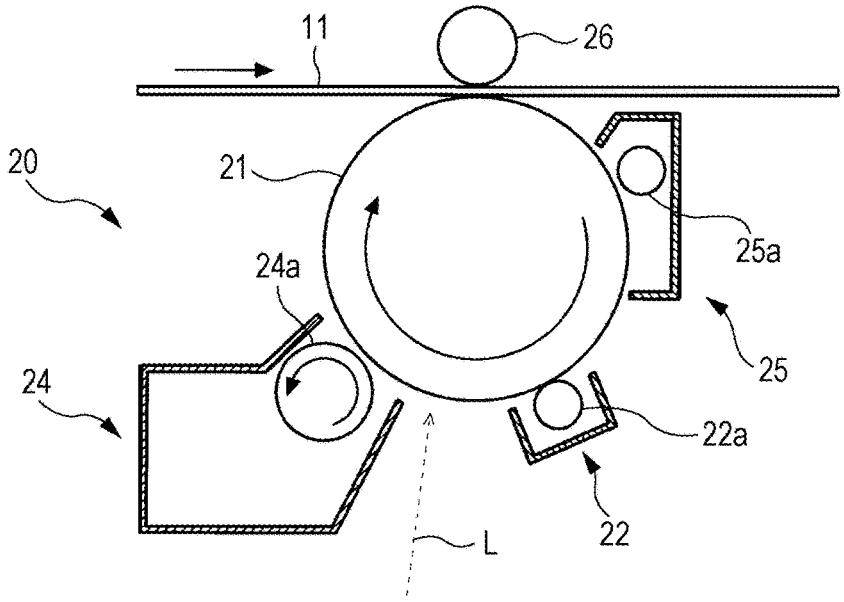
FIG. 3 is a schematic longitudinal sectional view of an image former of the image formation device according to the first embodiment of the present invention from the front side.

Subsequently, a configuration and operation of the image former 20 will be described with reference to FIGS. 1 and 3. FIG. 3 is a schematic longitudinal sectional view of the image former 20 from the front side. An upper-to-lower direction, a right-to-left direction, and a depth direction in the plane of paper of FIG. 3 correspond respectively to an upper-to-lower direction, a right-to-left direction, and a depth (front-to-back) direction of the image formation device 1 and the image former 20. Moreover, as described above, the image formers 20 for four colors have the common structure, and therefore, the identification symbols of "Y," "M," "C," and "K" are not used.

As illustrated in FIG. 3, the image former 20 includes, at the center thereof, the photosensitive drum 21 as the image carrier. The charger 22, the developer 24, and the drum cleaner 25 are arranged in this order along a rotation direction of the photosensitive drum 21 in the vicinity of the photosensitive drum 21. The primary transfer roller 26 is provided between the developer 24 and the drum cleaner 25 along the rotation direction of the photosensitive drum 21. Note that a not-shown neutralizer is disposed downstream of the drum cleaner 25 in the rotation direction of the photosensitive drum 21.

The photosensitive drum 21 extends in a sheet width direction forming a right angle with respect to the sheet conveying direction of the image formation device 1, i.e., the depth direction in the plane of paper of FIGS. 1 and 3, and is disposed such that the direction of axis of the photosensitive drum 21 is horizontal. The photosensitive drum 21 is an inorganic photosensitive drum configured such that a photosensitive layer made of an inorganic photoconductive material is provided on the outside of a conductive roller-shaped base made of aluminum, for example. The photosensitive drum 21 is rotated clockwise by a not-shown drive device as viewed from the front side such that the circumferential velocity thereof becomes substantially the same as a sheet conveying speed.

The charger 22 includes a charging roller 22*a* contacting the photosensitive drum 21. The charging roller 22*a* contacts the photosensitive drum 21 with predetermined pressure to rotate in association with rotation of the photosensitive drum 21. By the charging roller 22*a*, the surface of the photosensitive drum 21 is uniformly charged with predetermined potential with a negative polarity.

The exposure device 23 (see FIG. 1) irradiates the surface of the photosensitive drum 21 with laser light L modulated based on the data on the image to be formed. Thus, partial light attenuation of the potential charged by the charger 22 is caused, and the electrostatic latent image of the original document image is formed.

The developer 24 includes a development roller 24*a* as a development member. The development roller 24*a* is disposed such that a peripheral surface thereof faces the photosensitive drum 21 in proximity to a peripheral surface of the photosensitive drum 21. By the developer 24, toner of a developing agent is charged and supplied to the electrostatic latent image on the surface of the photosensitive drum 21. In this manner, the electrostatic latent image is developed. The developer 24 uses, as the developing agent, a two-component developing agent made of a mixture of non-magnetic toner particles and a magnetic carrier, for example.

The primary transfer roller 26 contacts the photosensitive drum 21 with the intermediate transfer belt 11 being interposed therebetween. The primary transfer roller 26 contacts the intermediate transfer belt 11 with predetermined pressure to rotate in association with rotation of the intermediate transfer belt 11. As necessary, a primary transfer bias with a polarity different from the charging polarities of the photosensitive drum 21 and the toner is applied to the primary transfer roller 26.

The drum cleaner 25 includes a cleaning roller 25*a* that contacts the photosensitive drum 21. The cleaning roller 25*a* contacts the photosensitive drum 21 with predetermined pressure, and is rotated by a not-shown drive device such that the circumferential velocity thereof becomes substantially the same as or slightly higher than that of the photosensitive drum 21. After the toner image formed on the surface of the photosensitive drum 21 has been transferred onto the intermediate transfer belt 11, the drum cleaner 25 removes and cleans the adhering object such as the toner remaining on the surface of the photosensitive drum 21.

The neutralizer is disposed downstream of the drum cleaner 25 along the rotation direction of the photosensitive drum 21. The neutralizer includes a plurality of light emitting diodes (LEDs) arranged in the direction of axis of the photosensitive drum 21 (the sheet width direction). The neutralizer irradiates the photosensitive drum 21 with neutralization light form the LEDs, thereby removing electrification charge from the surface of the photosensitive drum 21 to erase the electrostatic latent image. In this manner, the neutralizer makes preparation to charging in subsequent image formation operation.

Figure 4:
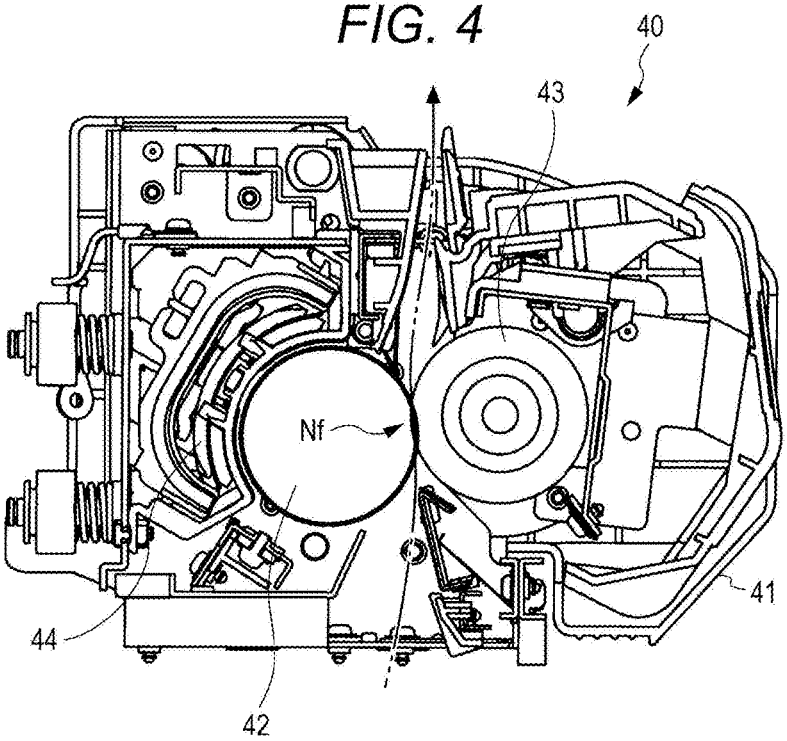
FIG. 4 is a schematic longitudinal sectional view of a fixing device of the image formation device according to the first embodiment of the present invention from the front side.

Subsequently, a configuration and operation of the fixer 40 will be described with reference to FIGS. 1 and 4. FIG. 4 is a schematic longitudinal sectional view of the fixer 40 from the front side. A chain double-dashed arrow of FIG. 4 indicates the sheet conveyance path and the sheet conveying direction. An upper-to-lower direction, a right-to-left direction, and a depth direction in the plane of paper of FIG. 4 correspond respectively to the upper-to-lower direction, the right-to-left direction, and the depth (front-to-back) direction of the image formation device 1 and the fixer 40.

The fixer 40 includes a housing 41, a fixing roller 42, a pressurizing roller 43, and a heater 44 as illustrated in FIG. 4.

The housing 41 covers the periphery of the fixing roller 42, the pressurizing roller 43, and the heater 44, and further supports these components.

The fixing roller 42 and the pressurizing roller 43 are both in a cylindrical shape, and are arranged in the right-to-left direction such that peripheral surfaces thereof face each other with the sheet conveyance path Q being interposed therebetween. The axes of rotation of the fixing roller 42 and the pressurizing roller 43 extend in the sheet width direction as the direction intersecting the sheet conveying direction, i.e., the front-to-back direction of the image formation device 1 and the fixer 40. The fixing roller 42 and the pressurizing roller 43 each have a length extending across an entire area of the sheet conveyance path Q in the sheet width direction. Rotary shafts of the fixing roller 42 and the pressurizing roller 43 are each rotatably supported by a not-shown bearing provided at the housing 41.

The fixing roller 42 has, for example, such a multilayer structure that a heat insulating layer, an elastic layer, a heat generation layer, a release layer, etc. are provided in this order toward an outer peripheral surface side in a radial direction on the outside of a core provided at the center of rotation. A surface of the fixing roller 42 generates heat by action of the heater 44 to heat the sheet P onto which the unfixed toner image has been transferred, thereby fixing the toner onto the sheet P.

Predetermined pressure is provided to the pressurizing roller 43 by a not-shown pressurizing mechanism using, e.g., a spring member, and accordingly, a peripheral surface of the pressurizing roller 43 press-contacts the peripheral surface of the fixing roller 42 to form a fixing nip portion Nf. The pressurizing roller 43 obtains power from a not-shown drive source to rotate clockwise as viewed in FIG. 4. The fixing roller 42 rotates counterclockwise as viewed in FIG. 4 in association with rotation of the pressurizing roller 43 whose peripheral surface contacts the peripheral surface of the fixing roller 42. Note that the fixing roller 42 may be rotatably driven to rotatably drive the pressurizing roller 43.

The heater 44 is disposed adjacent to the fixing roller 42 on the outside of the fixing roller 42 in a region on the opposite side of the fixing roller 42 from the side on which the pressurizing roller 43 is disposed. The heater 44 extends along the sheet width direction as in the fixing roller 42. The heater 44 includes, for example, a not-shown excitation coil, a not-shown magnetic core, and a not-shown shield member, and is configured as an induction heating source that generates heat from the surface of the fixing roller 42 by induction heating. The temperature of the surface of the fixing roller 42 is detected by a temperature detector including a not-shown thermistor etc., and the main controller 5 controls the heater 44 based on such a temperature. Note that a configuration of the heater 44 that generates heat from the surface of the fixing roller 42 is not limited to the induction heating source, and heat may be generated from the surface of the fixing roller 42 by means of other configurations such as a heater.

The image formation device 1 has a printing mode called a toner increase mode, and can utilize such a mode. The toner increase mode is different from the density adjustment setting of using the density adjustment icon 4*a* on the display 4*w* by the user to optionally adjust the density of the image to be printed on the sheet P. In the toner increase mode, more toner than that in the case of selecting the maximum density selectable by the density adjustment setting is applied to the sheet P. With this mode, the user can obtain a printed document resistant to long-term storage.

The toner increase mode is selectable via the operator 4. As illustrated in FIG. 2, the image formation device 1 displays, on the display 4*w*, a toner increase mode icon 4*b* for selecting the toner increase mode, for example. In the case of receiving a printing job from the external computer etc. via the network, the toner increase mode is selectable by means of a printer driver.

Figure 5:
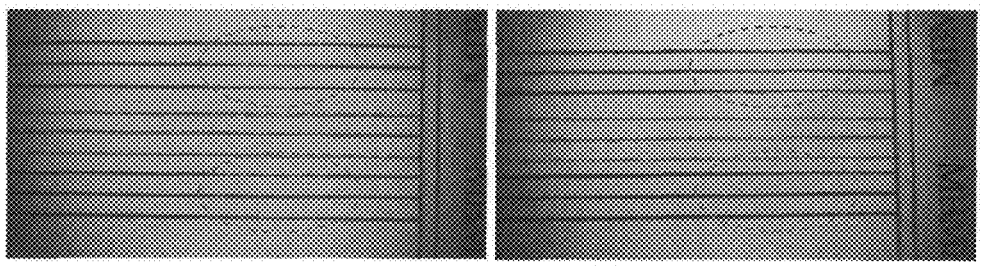
FIG. 5 includes a table and views for describing a toner increase by the image formation device according to the first embodiment of the present invention and abrasion evaluation of a printed image.
Figure 6:
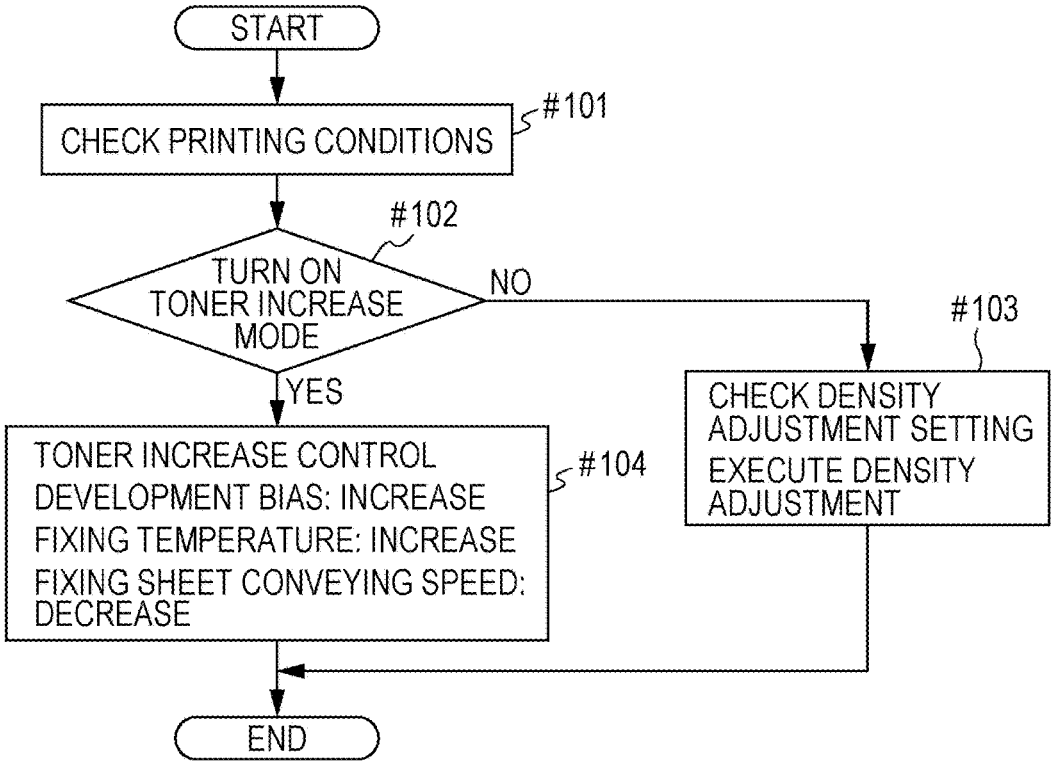
FIG. 6 is a flowchart of an example of processing for the density of the printed image in the image formation device according to the first embodiment of the present invention.

Subsequently, a detailed configuration of the image formation device 1 regarding the toner increase mode will be described with reference to FIGS. 5 and 6. FIG. 5 includes a table and views for describing a toner increase by the image formation device 1 and abrasion evaluation of the printed image. FIG. 6 is a flowchart of an example of processing for the density of the printed image in the image formation device 1.

The toner increase mode changes an image formation process condition to change the amount of toner adhering to the sheet P. That is, in the toner increase mode, for applying more toner to the image printed on the sheet P as compared to the normal density adjustment setting, the development bias of the developer 24 is increased as compared to that in the case of adjusting the density of the printed image based on the density adjustment setting. Details of the development bias in the toner increase mode will be described later. Note that instead of the change in the development bias, the exposure light amount of the exposure device 23 may be increased as compared to that in the case of the density adjustment setting.

Moreover, in the toner increase mode, the fixing temperature of the fixer 40 is increased as compared to that in the case of adjusting the density of the printed image based on the density adjustment setting. For example, the fixing temperature in the toner increase mode is 185° C. as compared to a fixing temperature of 160° C. in the case of the density adjustment setting. As described above, the fixing temperature is higher in the toner increase mode than in the normal printing mode, and for the change in the fixing temperature, predetermined standby time is provided upon the start and end of the printing job using the toner increase mode.

Moreover, in the toner increase mode, the conveying speed of the sheet P at the fixing nip portion Nf is decreased as compared to that in the case of adjusting the density of the printed image based on the density adjustment setting. For example, the sheet conveying speed at the fixing nip portion Nf in the toner increase mode is 105 mm/s, whereas the sheet conveying speed at the fixing nip portion Nf in the case of the density adjustment setting is 210 mm/s.

Regarding this toner increase mode, an abrasion test has been, for obtaining the printed document resistant to long-term storage, conducted for the sheet P on which the image has been printed. A toner increase and abrasion evaluation of the printed image will be described in detail with reference to FIG. 5.

In abrasion evaluation of the printed image in the toner increase mode, the fixing temperature was 185° C., the sheet conveying speed at the fixing nip portion Nf was 105 mm/s, and the development bias was changed to four conditions. As illustrated in FIG. 5, when the development bias changed within a range of a default value to +250 V, the toner adhesion amount changed within a range of 4.2 to 9.7 g/m$^2$. Note that the "default value" of the development bias means a voltage value of the development bias used in the case of the normal density adjustment setting.

Note that the "toner adhesion amount" described herein means a toner amount on a predetermined certain area of the sheet P. The toner adhesion amount is substantially in a proportional relationship with an output value of an image density control (IDC) sensor that detects the image density, and therefore, is derived corresponding to the output value of the image density control sensor.

The abrasion test has been conducted according to ISO9532. Evaluation paper was "SVENSKT ARKIV 80," and an evaluation machine was a "Taber abrasion testing machine (Abrasion Wheel CS10F, a test load of 2.5 N)."

A "line" of the printed image and a reference ink line drawn with reference ink were simultaneously abraded. Abrasion was performed until the absorption rate of the reference ink line decreases to a range of 80 to 85%. At this point, a ratio between the absorption rate of the image and the absorption rate of the reference ink line was greater than 0.8 based on the following expression:

$$(Ai1/Ai2)/(Ar1/Ar2)>0.8$$

where Ai1 is an absorption rate (for the image at an initial stage),

Ai2 is an absorption rate (for the image after abrasion),

Ar1 is an absorption rate (for the reference ink line at the initial stage), and Ar2 is an absorption rate (for the reference ink line after abrasion).

A "character" of the printed image was abraded until a rotation speed determined in line evaluation as described above reaches ¼ rotation. For example, in the case of abrasion with 100 rotations in line evaluation, abrasion is performed with 25 rotations in character evaluation, provided that image detachment such as partial deletion or void of the character is not caused.

As a result of the abrasion test, when the development bias was the default value, the amount of toner adhering to the image printed on the sheet P was 4.2 g/m$^2$ according to FIG. 5, and abrasion test evaluation was "not favorable" (A). Thus, favorable abrasion resistance cannot be obtained. A lower left image of FIG. 5 clearly shows blurring of the line of the printed image, for example. That is, in the case of the normal density adjustment setting with the default development bias value, there is a probability that the printed document resistant to long-term storage cannot be obtained.

On the other hand, when the development bias was +150 V, the amount of toner adhering to the image printed on the sheet P was 5.2 g/m$^2$, abrasion test evaluation was "not favorable" (Δ) to "favorable" (○), and the abrasion resistance was slightly improved. Further, when the development bias was +200 V, the amount of toner adhering to the image printed on the sheet P was 7.4 g/m$^2$, and abrasion test evaluation was "favorable" (○). Thus, favorable abrasion resistance can be obtained. A lower right image of FIG. 5 shows that no blurring of the line of the printed image was caused, for example.

As described above, the abrasion resistance of the printed image was improved in such a manner that the toner adhesion amount is increased from 4.2 g/m$^2$ to 5.2 g/m$^2$, i.e., the toner adhesion amount is increased by about 20%. Thus, the toner increase mode of the image formation device 1 changes the image formation process condition such that the amount of toner adhering to the sheet P is increased by 20% or more as compared to that based on the density adjustment setting. That is, in the toner increase mode, the development bias is increased by +150 V or more as compared to that in the case of adjusting the density of the printed image based on the density adjustment setting, for example. For further improving the abrasion resistance of the printed image, the toner adhesion amount is preferably 7.4 g/m$^2$.

Next, the processing for the density of the printed image in the image formation device 1 will be described in detail with reference to FIG. 6.

In printing operation of the image formation device 1, when the processing for the density of the printed image begins (START of FIG. 6), the printing conditions are checked at a step #101.

At a step #102, it is determined whether or not the toner increase mode is selected as the printing condition (the toner increase mode is ON). In a case where the toner increase mode is not selected, the processing transitions to a step #103. In a case where the toner increase mode is selected, the processing transitions to a step #104.

At the step #103, the density adjustment setting is checked for executing the normal density adjustment setting. Then, the density of the image to be printed on the sheet P is adjusted based on the density adjustment setting.

At the step #104, control for the toner increase mode is executed. In the toner increase mode, the development bias is increased as compared to that in the case of adjusting the density of the printed image based on the density adjustment setting. Moreover, in the toner increase mode, the fixing temperature is increased as compared to that in the case of adjusting the density of the printed image based on the density adjustment setting. Further, in the toner increase mode, the conveying speed of the sheet P at the fixing nip portion Nf is decreased as compared to that in the case of adjusting the density of the printed image based on the density adjustment setting.

As in the above-described embodiment, the image formation device 1 has, as the printing condition, the density adjustment setting of optionally adjusting the density of the printed image by the user, as well as having, as the printing mode, the toner increase mode for applying more toner to the sheet P than that in the case of selecting the maximum density selectable by the density adjustment setting.

According to this configuration, the toner increase mode allows application of more toner to the sheet P as compared to that in the case of selecting the maximum density selectable in the density adjustment setting as the general printing condition for optionally adjusting, by the user, the density of the image to be printed on the sheet P. With this configuration, the abrasion resistance of the image printed on the sheet P can be improved. Thus, the image can be maintained clear, and the printed document resistant to long-term storage can be obtained.

That is, the amount of toner adhering to the sheet P in the toner increase mode is greater by 20% or more than that based on the density adjustment setting. Thus, in a case where abrasion of the printed image becomes advanced, a base sheet (a sheet surface) can be less noticeable. Consequently, the abrasion resistance of the image printed on the sheet P is improved.

Moreover, in the toner increase mode, the fixing temperature is increased as compared to that in the case of adjusting the density of the printed image based on the density adjustment setting. Further, in the toner increase mode, the conveying speed of the sheet P at the fixing nip portion Nf is decreased as compared to that in the case of adjusting the density of the printed image based on the density adjustment setting. According to these configurations, fixability of the toner onto the sheet P can be enhanced. Thus, the abrasion resistance of the image printed on the sheet P can be improved.

Note that the predetermined standby time is provided upon the start and end of the printing job using the toner increase mode. In the toner increase mode, the fixing temperature is higher than that of the normal printing mode. According to such a configuration, the fixing temperature can be properly changed upon switching of ON/OFF of the toner increase mode.

In addition, in the toner increase mode, the amount of toner adhering to the sheet P is changed by the change in the image formation process condition, and such an image formation process condition is the development bias. According to such a configuration, the amount of toner adhering to the sheet P can be easily changed by the change in the development bias.

The toner increase mode is selectable from the device body or the printer driver. According to these configurations, in any of the case of operating the operator 4 to execute printing and the case of executing printing from the external computer via the network, the toner increase mode can be utilized.

The black toner might exhibit lower abrasion resistance as compared to those of the toners in other colors such as yellow, magenta, and cyan. For this reason, in the image formation device 1 including the image formers 20 that form the toner images with the toners in multiple colors including black, the percentage of the increment of the black toner for the sheet P is, in the toner increase mode, preferably greater than those of the toners in other colors. For example, for the percentage of the increment of the black toner, the amount of toner adhering to the sheet P is preferably 7.4 g/m$^2$ in FIG. 5.

For example, when the amount of toner adhering to the sheet P in FIG. 5 is 5.2 g/m$^2$ with the percentage of the increment being substantially the same among the toners in other colors than black, the abrasion resistance of the image printed on the sheet P is improved while an increase in the amount of toner consumption can be suppressed.

Moreover, in the toner increase mode, more toner is applied only to the "line" of the printed image on the sheet P as compared to that in the case of selecting the maximum density selectable in the density adjustment setting. According to such a configuration, a difficulty in recognition of the blurred "character" of the printed image due to a toner increase can be prevented while an increase in the amount of toner consumption can be suppressed. Note that in the case of changing the toner adhesion amount only for the "line" of the printed image, such a change can be realized by a change in the exposure light amount of the exposure device 23.

Second Embodiment

Figure 7:
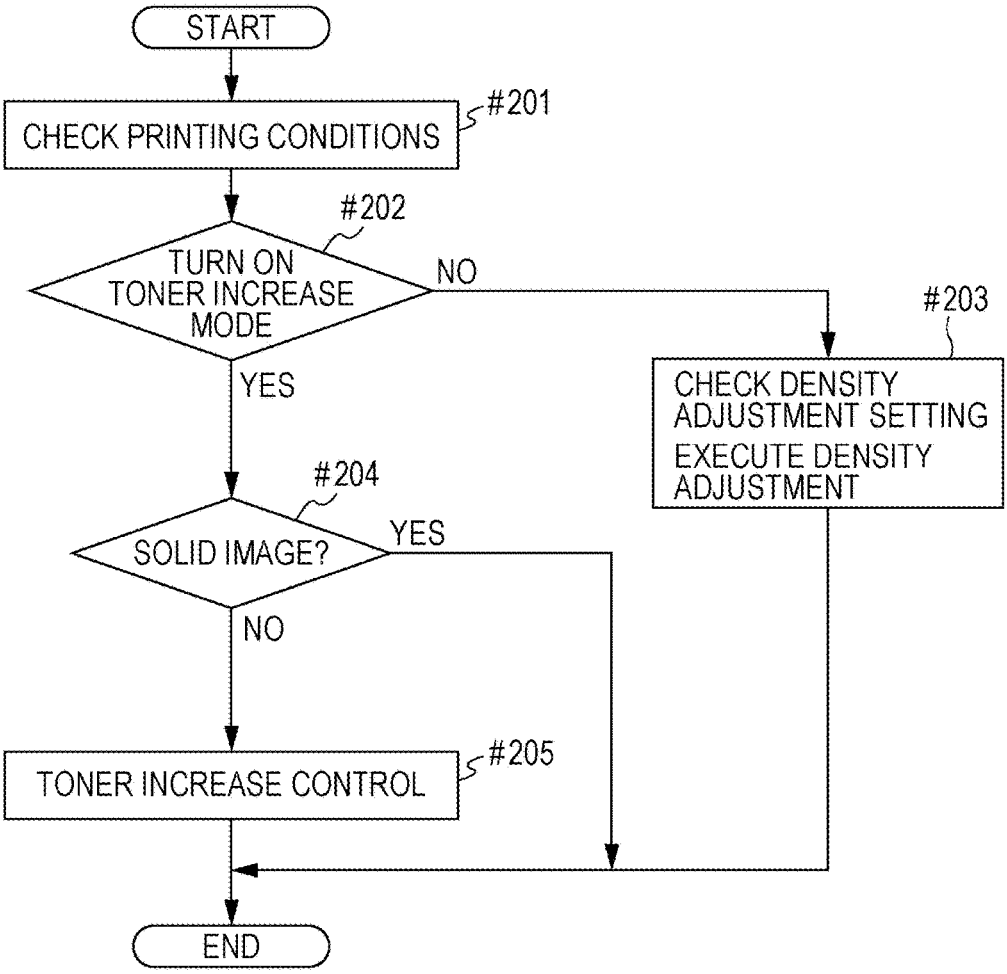
FIG. 7 is a flowchart of an example of processing for the density of a printed image in an image formation device according to a second embodiment of the present invention.

Next, an image formation device according to a second embodiment of the present invention will be described with reference to FIG. 7. FIG. 7 is a flowchart of an example of processing for the density of a printed image in the image formation device. Note that a basic configuration of this embodiment is the same as that of the first embodiment described above. Thus, the same names and reference numerals as those of the first embodiment are used to represent equivalent components, and detailed description thereof might not be repeated.

In printing operation of the image formation device 1 of the second embodiment, when the processing for the density of the printed image begins (START of FIG. 7), printing conditions are checked at a step #201. Subsequent steps #202, #203, #205 are the same as the steps #102, #103, #104 of FIG. 6 described in the first embodiment, and therefore, description thereof will not be repeated.

At a step #204, it is determined whether or not the image to be printed on a sheet P is a solid image, a toner increase mode being to be executed for the image. In a case where the image to be printed is not the solid image, the processing transitions to a step #205, and control for the toner increase mode is executed.

On the other hand, in a case where the image to be printed is the solid image, the image formation device 1 does not execute printing using the toner increase mode, and ends the processing for the density of the printed image (END of FIG. 7). In the case where the image to be printed is the solid image, the probability of purposefully selecting the toner increase mode is low, and therefore, the image formation device 1 of the second embodiment does not execute printing using the toner increase mode. Thus, unnecessary toner consumption can be prevented.

Third Embodiment

Figure 8:
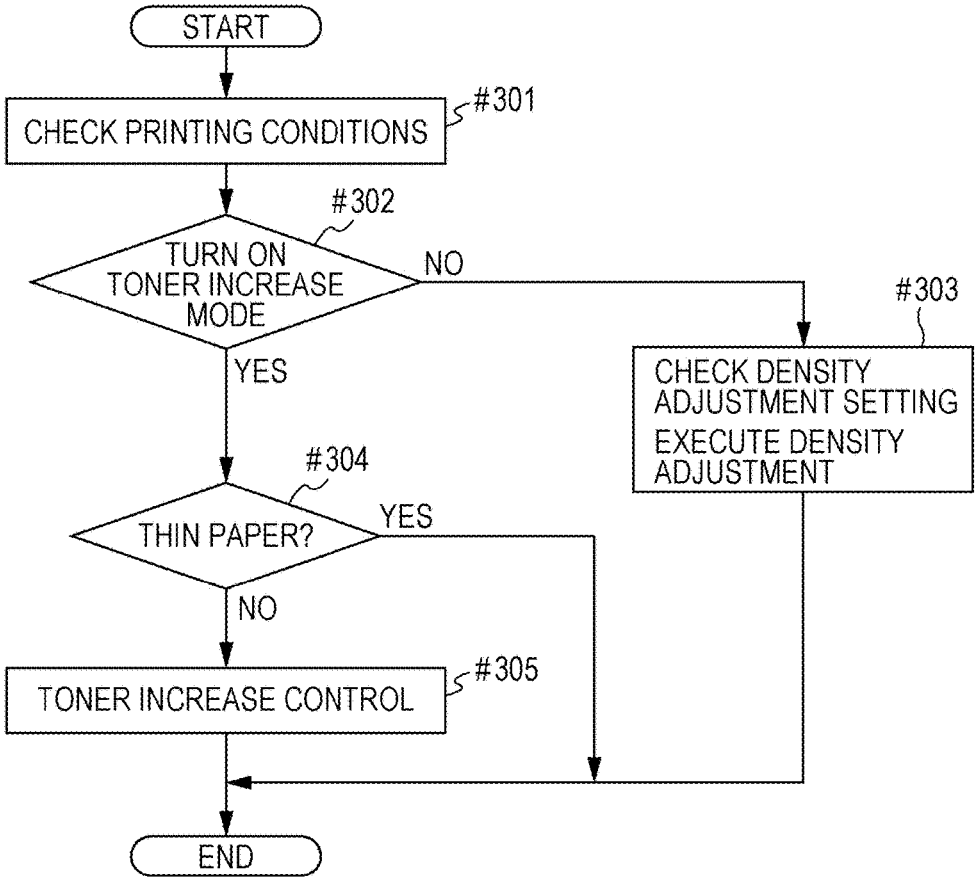
FIG. 8 is a flowchart of an example of processing for the density of a printed image in an image formation device according to a third embodiment of the present invention.

Next, an image formation device according to a third embodiment of the present invention will be described with reference to FIG. 8. FIG. 8 is a flowchart of an example of processing for the density of a printed image in the image formation device. Note that a basic configuration of this embodiment is the same as that of the first embodiment described above. Thus, the same names and reference numerals as those of the first embodiment are used to represent equivalent components, and detailed description thereof might not be repeated.

In printing operation of the image formation device 1 of the third embodiment, when the processing for the density of the printed image begins (START of FIG. 8), printing conditions are checked at a step #301. Subsequent steps #302, #303, #305 are the same as the steps #102, #103, #104 of FIG. 6 described in the first embodiment, and therefore, description thereof will not be repeated.

At a step #304, it is determined whether or not a sheet P for which a toner increase mode is to be executed is thin paper having a thickness smaller than a predetermined thickness. In a case where the sheet P is not the general so-called thin paper, the processing transitions to a step #305, and control for the toner increase mode is executed.

On the other hand, in a case where the sheet P is the thin paper, the image formation device 1 does not execute printing using the toner increase mode, and ends the processing for the density of the printed image (END of FIG. 8). The thin paper is not suitable for a printed document resistant to long-term storage, and the probability of purposefully selecting the toner increase mode is low. Thus, the image formation device 1 of the third embodiment does not execute printing using the toner increase mode. Consequently, unnecessary toner consumption can be prevented.

Fourth Embodiment

Figure 9:
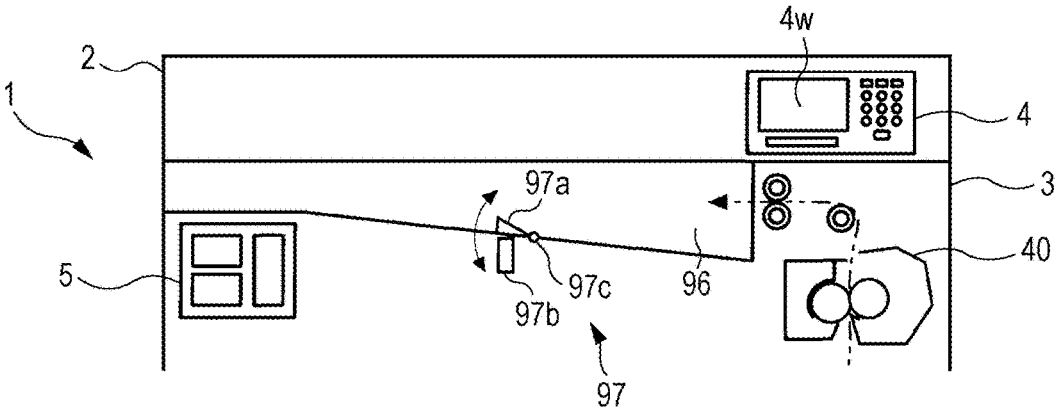
FIG. 9 is a partial enlarged longitudinal sectional view of an image formation device according to a fourth embodiment of the present invention from a front side.
Figure 10:
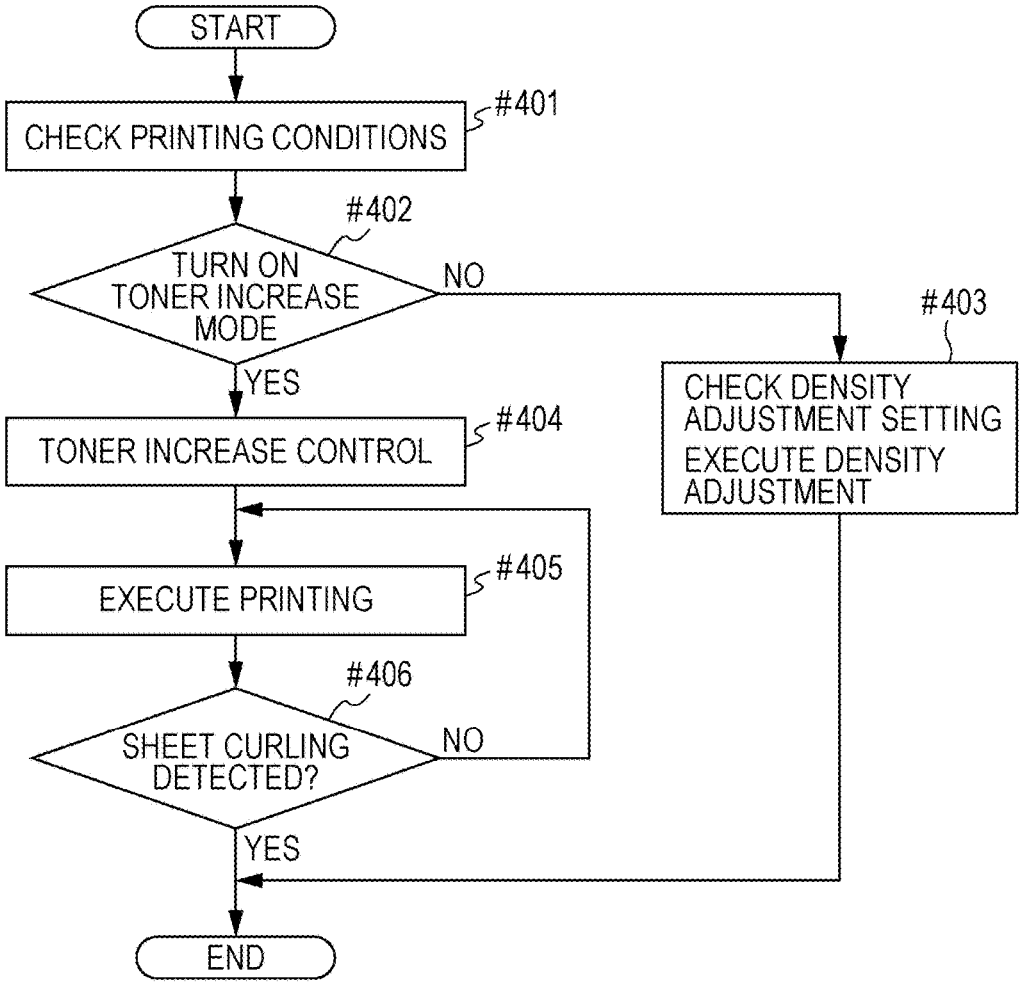
FIG. 10 is a flowchart of an example of processing for the density of a printed image in the image formation device according to the fourth embodiment of the present invention.

An image formation device according to a fourth embodiment of the present invention will be described with reference to FIGS. 9 and 10. FIG. 9 is a partial enlarged longitudinal sectional view of the image formation device from a front side. FIG. 10 is a flowchart of an example of processing for the density of a printed image in the image formation device. Note that a basic configuration of this embodiment is the same as that of the first embodiment described above. Thus, the same names and reference numerals as those of the first embodiment are used to represent equivalent components, and detailed description thereof might not be repeated.

The image formation device 1 of the fourth embodiment includes a curling detector 97 at a sheet discharger 96 of FIG. 9. The curling detector 97 includes a contact piece 97*a* and a sensor 97*b*.

The contact piece 97*a* is, via a shaft portion 97*c* extending in a sheet width direction, supported by a device body to swing clockwise or counterclockwise as viewed in FIG. 9. The contact piece 97*a* is, by a not-shown biasing member, biased to the state of protruding upward from a surface of the sheet discharger 96. The biasing member has such biasing force that the contact piece 97*a* sinks to below the sheet discharger 96 by contact between a sheet P discharged to the sheet discharger 96 and the contact piece 97*a*.

The sensor 97*b* is disposed below the sheet discharger 96. The sensor 97*b* includes, for example, a transmission optical sensor. The sensor 97*b* detects, by light blocking by the contact piece 97*a*, that the contact piece 97*a* sinks to below the sheet discharger 96 by contact with the sheet P. That is, the curling detector 97 detects, based on non-contact of the sheet P discharged to the sheet discharger 96 with the contact piece 97*a*, that more curling of the sheet P than a predetermined degree of curling is caused after image printing.

Note that the curling detector 97 may use an optical sensor that detects a distance, thereby detecting curling of the sheet P after image printing.

In printing operation of the image formation device 1 of the fourth embodiment, when the processing for the density of the printed image begins (START of FIG. 10), printing conditions are checked at a step #401. Subsequent steps #402, #403, #404 are the same as the steps #102, #103, #104 of FIG. 6 described in the first embodiment, and therefore, description thereof will not be repeated.

At a step #405, printing on the sheet P is executed in a toner increase mode.

At a step #406, the curling detector 97 is used to determine whether or not more curling of the sheet P than the predetermined degree of curling is caused after image printing. In a case where no curling of the sheet P is caused, the processing returns to the step #405, and printing is continuously executed in the toner increase mode.

On the other hand, in a case where more curling of the sheet P than the predetermined degree of curling is detected by the curling detector 97, the image formation device 1 stops such a printing job, and ends the processing for the density of the printed image (END of FIG. 10). The amount of heat for fixing in the toner increase mode is great, and therefore, curling tends to occur at the sheet P. The sheet P with relatively-great curling is not suitable for long-term storage, and for this reason, the image formation device 1 of the fourth embodiment stops the printing job using the toner increase mode. Thus, unnecessary toner consumption can be prevented.

Fifth Embodiment

Figure 11:
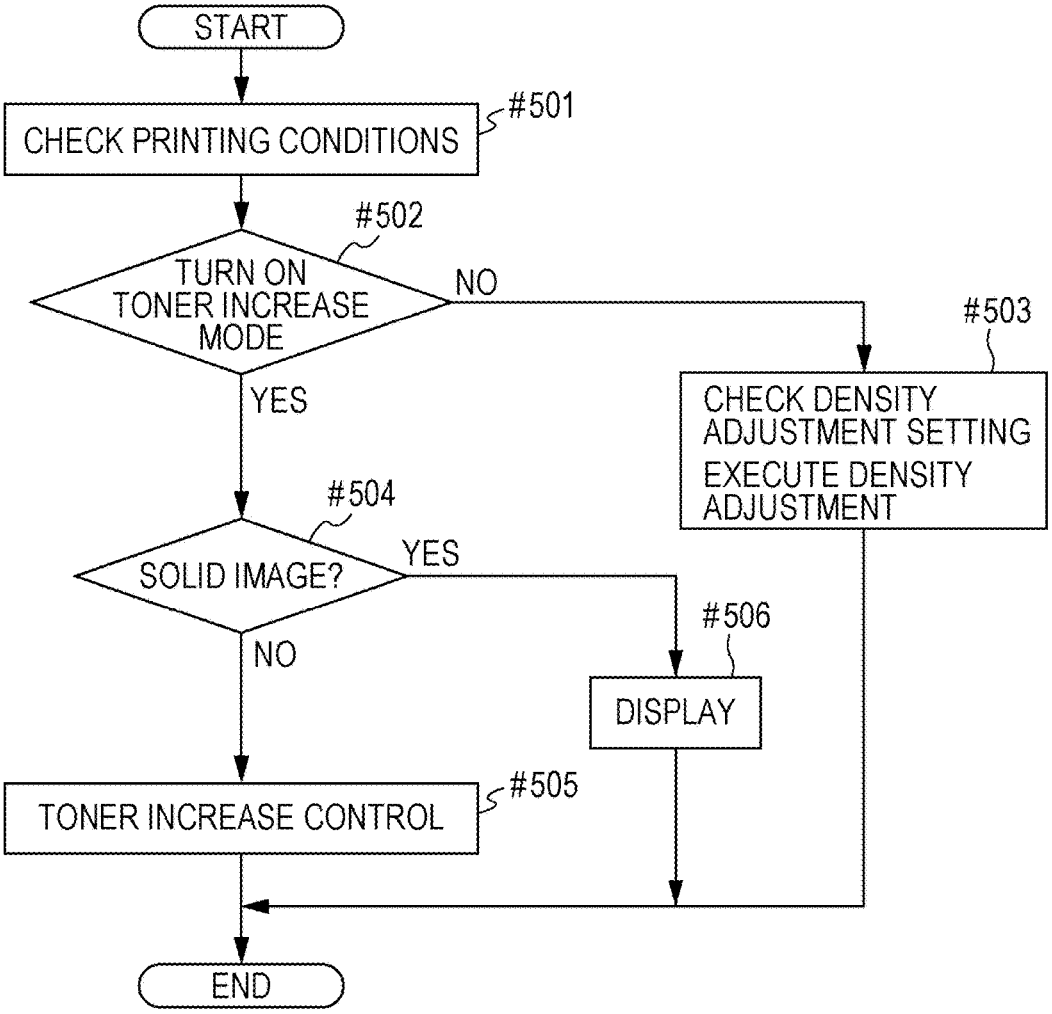
FIG. 11 is a flowchart of an example of processing for the density of a printed image in an image formation device according to a fifth embodiment of the present invention.

Next, an image formation device according to a fifth embodiment of the present invention will be described with reference to FIG. 11. FIG. 11 is a flowchart of an example of processing for the density of a printed image in the image formation device. Note that a basic configuration of this embodiment is the same as those of the first and second embodiments described above. Thus, the same names and reference numerals as those of the first and second embodiments are used to represent equivalent components, and detailed description thereof might not be repeated.

In printing operation of the image formation device 1 of the fifth embodiment, when the processing for the density of the printed image begins (START of FIG. 11), printing conditions are checked at a step #501. Subsequent steps #502 to #505 are the same as the steps #202 to #205 of FIG. 7 described in the second embodiment, and therefore, description thereof will not be repeated.

At the step #504, in a case where the image to be printed is a solid image, an operator 4 as a notifier is, at a step #506, used to notify a user that a printing job using a toner increase mode is not executed. For example, the operator 4 displays, on a display 4*w*, that the printing job using the toner increase mode is not executed. Alternatively, the operator 4 may perform notification utilizing sound etc., for example.

As described above, according to the configuration of the fifth embodiment, in a case where the image formation device 1 does not execute or stops the printing job using the toner increase mode, the image formation device 1 uses the notifier 4 to notify such a state. Thus, the user can easily grasp the state of not executing the printing job using the toner increase mode and the reason for such a state.

Sixth Embodiment

Figure 12:
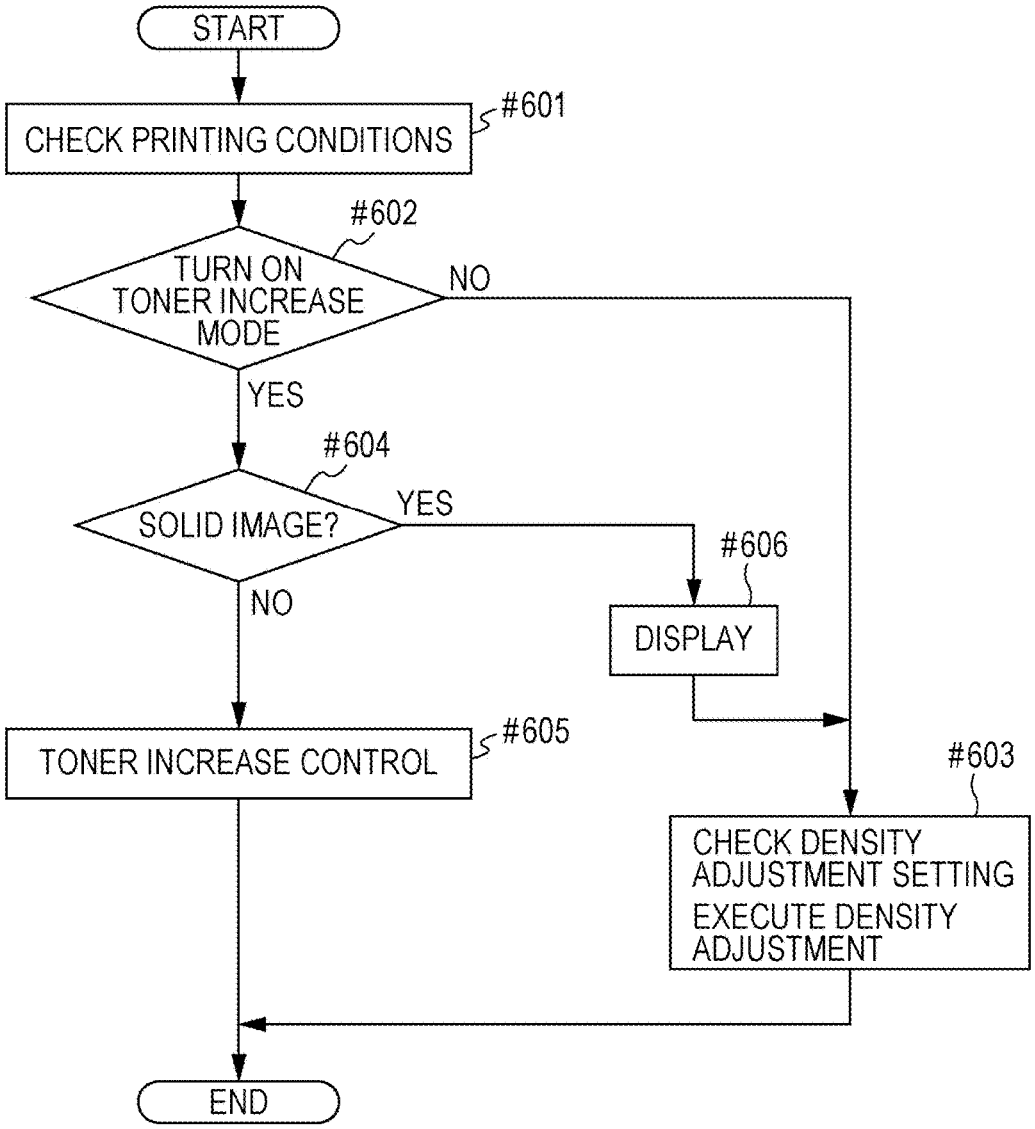
FIG. 12 is a flowchart of an example of processing for the density of a printed image in an image formation device according to a sixth embodiment of the present invention.

Next, an image formation device according to a sixth embodiment of the present invention will be described with reference to FIG. 12. FIG. 12 is a flowchart of an example of processing for the density of a printed image in the image formation device. Note that a basic configuration of this embodiment is the same as those of the first and fifth embodiments described above. Thus, the same names and reference numerals as those of the first and fifth embodiments are used to represent equivalent components, and detailed description thereof might not be repeated.

In printing operation of the image formation device 1 of the sixth embodiment, when the processing for the density of the printed image begins (START of FIG. 12), printing conditions are checked at a step #601. Subsequent steps #602 to #606 are the same as the steps #502 to #506 of FIG. 11 described in the fifth embodiment, and therefore, description thereof will not be repeated.

At the step #606, when an operator 4 is used to notify a user that a printing job using a toner increase mode is not executed, the processing transitions to the step #603. That is, the toner increase mode is not executed, but a normal density adjustment setting is checked for executing such a setting. Then, based on the density adjustment setting, the density of the image to be printed on a sheet P is adjusted.

As described above, according to the configuration of the sixth embodiment, in a case where the image formation device 1 does not execute or stops the printing job using the toner increase mode, the image formation device 1 executes the printing job with a predetermined density selectable in the density adjustment setting. Thus, even when the toner increase mode is not applied, the user can obtain a document printed based on the normal density adjustment setting.

The present invention can be utilized in an image formation device.

Although embodiments of the present invention have been described and illustrated in detail, it is clearly understood that the same is by way of illustration and example only and not limitation, the scope of the present invention should be interpreted by terms of the appended claims Various changes can be made without departing from the gist of the invention. For example, the "toner increase mode" in the present invention may be replaced with a "document saving mode" or a "document storage mode." Accordingly, the toner increase mode icon 4*b* illustrated in FIG. 2 may be also referred to as "document saving" or "document storage."

What is claimed is:

1. An image formation device for forming a toner image as an image to be printed on a sheet to transfer and fix the unfixed toner image onto the sheet, the image formation device comprising a hardware processor configured to:

implement a density adjustment setting for adjusting a density of a printed image set by a user is provided as a printing condition, and implement a toner increase mode for applying, to the sheet, more toner than that in a case of selecting a maximum density selectable in the density adjustment setting is provided as a printing mode.

2. The image formation device according to claim 1, wherein in the toner increase mode, an amount of toner adhering to the sheet is greater by 20% or more than that based on the density adjustment setting.

3. The image formation device according to claim 2, wherein predetermined standby time is provided upon start and end of a printing job using the toner increase mode.

4. The image formation device according to claim 1, wherein in the toner increase mode, a fixing temperature for fixing the unfixed toner image onto the sheet is higher than that in a case of adjusting the density of the printed image based on the density adjustment setting.

5. The image formation device according to claim 1, wherein in the toner increase mode, a sheet conveying speed at a fixing nip portion is lower than that in a case of adjusting the density of the printed image based on the density adjustment setting.

6. The image formation device according to claim 1, wherein in the toner increase mode, an amount of toner adhering to the sheet is changed by a change in an image formation process condition.

7. The image formation device according to claim 6, wherein the image formation process condition is a development bias.

8. The image formation device according to claim 6, wherein the image formation process condition is an exposure light amount.

9. The image formation device according to claim 1, wherein in a case where the image to be printed on the sheet is a solid image, printing using the toner increase mode is not executed.

10. The image formation device according to claim 9, wherein the hardware processor is further configured to notify the user of a device state, wherein in a case where a printing job using the toner increase mode is not executed or is stopped, the hardware processor is used to notify the user that the printing job is not executed or is stopped.

11. The image formation device according to claim 9, wherein in a case where a printing job using the toner increase mode is not executed or is stopped, the printing job is executed with a predetermined density selectable in the density adjustment setting.

12. The image formation device according to claim 1, wherein in a case where the sheet on which the image is to be printed is thin paper having a thickness smaller than a predetermined thickness, printing using the toner increase mode is not executed.

13. The image formation device according to claim 1, further comprising:

a curling detector that detects curling of the sheet after image printing, wherein in a case where the curling detector detects the curling of the sheet during execution of a printing job using the toner increase mode, the printing job is stopped.

14. The image formation device according to claim 1, further comprising:

means for forming toner images using toners in multiple colors including black, wherein in the toner increase mode, a percentage of an increment of the black toner on the sheet is greater than those of the toners in other colors.

15. The image formation device according to claim 14, wherein in the toner increase mode, the percentage of the increment is substantially identical among the toners in other colors than the black.

16. The image formation device according to claim 1, wherein the toner increase mode is selectable from a device body or a printer driver.

17. The image formation device according to claim 1, wherein in the toner increase mode, more toner is applied only to a line of the printed image on the sheet as compared to a case of selecting a maximum density selectable in the density adjustment setting.

* * * * *